United States Patent [19]

Riggs et al.

[11] 3,940,801

[45] Mar. 2, 1976

[54] PILLION RIDER BELT

[76] Inventors: Lawrence H. Riggs, 304 Watson Ave., Fairmont, W. Va. 26554; William J. Curn, 397 Lawson Ave., Steubenville, Ohio 43952

[22] Filed: Nov. 4, 1974

[21] Appl. No.: 520,364

[52] U.S. Cl. ..... 2/311

[51] Int. Cl.[2] ..... A41F 9/00

[58] Field of Search ..... 182/3; 2/300, 301, 311, 2/319, 321, 322, 325, 338, 94; 128/76, 558

[56] References Cited

UNITED STATES PATENTS

| | | | |
|---|---|---|---|
| 698,005 | 4/1902 | Geisenheimer | 2/338 |
| 1,903,081 | 3/1933 | Wotherspoon | 2/338 X |
| 2,063,886 | 12/1936 | Alexandre | 2/338 X |
| 2,905,948 | 9/1959 | Grisanti | 2/338 X |
| 2,914,070 | 11/1959 | Kellner et al. | 2/311 X |
| 3,487,474 | 1/1970 | De Meo | 2/311 |
| 3,562,812 | 2/1971 | Greggains | 182/3 X |
| 3,564,616 | 2/1971 | Battaglia | 2/311 |

*Primary Examiner*—G. V. Larkin

*Attorney, Agent, or Firm*—Buell, Blenko, and Ziesenheim

[57] ABSTRACT

A belt for a pillion rider. The belt has a pair of straps along the longitudinal outside face of the belt. The ends of the straps are secured through a slit in the belt and fastened to the inside face of the belt. The belt is secured around the waist of a driver and the pillion rider holds onto the pair of straps.

1 Claim, 1 Drawing Figure

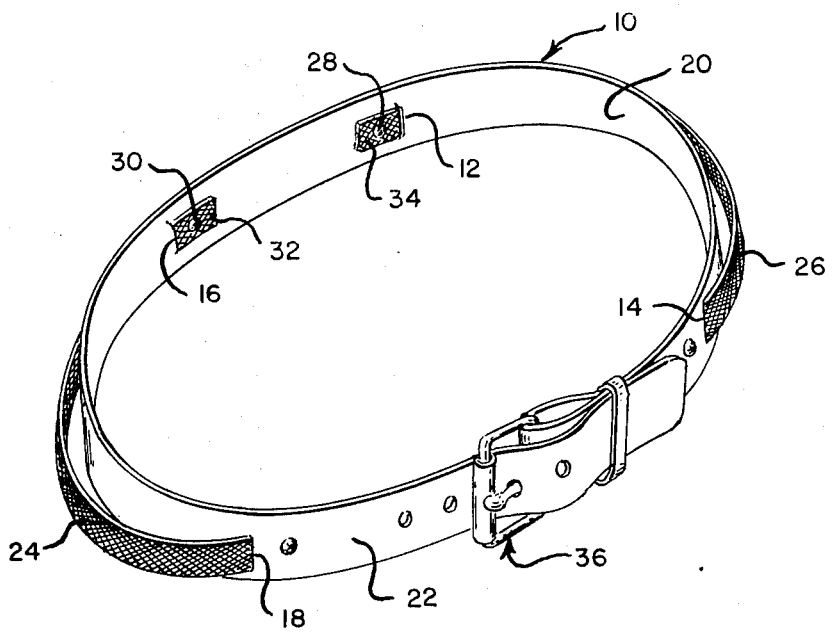
10
28
20
30
12
34
32
26
16
14
24
36
22
18

PILLION RIDER BELT

This invention relates to belts which are designed for pillion riders.

A cyclist, equestrian and snowmobile driver frequently carry a passenger in tandem. These riders known as pillion or tandem riders hold onto the waist of the driver. If the ride is rough the grip can become loose and the rider can fall.

The instant invention provides a belt worn by the driver and used by the pillion rider to maintain a grip.

We provide a pillion rider belt comprising a belt having four slits spaced apart along a longitudinal axis of the belt, the belt having an inside face and an outside face; a pair of straps along the longitudinal axis of the outside face of the belt, the ends of each of the straps are inserted through a corresponding slit and fastened to the inside face of the belt; and means fastening the belt.

Other details, objects and advantages of this invention will become apparent as the following description of the present preferred embodiment proceeds.

In the accompanying drawing, we have shown a present preferred embodiment of the invention in which:

The FIGURE is an isometric view of the belt for a pillion rider.

The FIGURE shows a belt 10 having four slits 12, 14, 16 and 18 which are spaced apart along the longitudinal axis of the belt 10. The belt 10 has inside and outside faces 20 and 22. A pair of straps 24 and 26 are located along the longitudinal axis of the outside face 22 of the belt. The ends (only two of which are shown 32 and 34) of each of the straps 24 and 26 are inserted through a corresponding slit (12, 14, 16 and 18) and fastened to the inside face 20 by rivets, or sewing, or by both rivets and sewing (28 and 30 shown). The belt 10 is fastened by a buckle assembly 36. The fastening arrangement for the straps 24 and 26 inserted through slits (12–18) provides additional security. The driver wears the belt and the pillion rider holds the straps 24 and 26.

The straps can also be secured to the belt by passing a loop of steel, leather or other material through the slits 12, 14, 16 and 18 and fastening the straps 24 and 26 to such loops; or by fastening the straps 24 and 26 by other means directly to the outside face 22 of the belt; the purpose being to control the sheer force exerted on the straps 24 and 26 or their fastening.

We claim:

1. A pillion rider belt comprising:

a. a belt having four slits spaced apart along a longitudinal axis of the belt, the belt having an inside face and an outside face;

b. a pair of straps along the longitudinal axis of the outside face of the belt, the ends of each of the straps being inserted through a corresponding slit and fastened to the inside face of the belt; and c. means fastening the belt.

* * * * *